United States Patent [19]

Benoit

[11] 4,120,643

[45] Oct. 17, 1978

[54] METHOD OF REGULATING THE PROCESS OF AGGLOMERATION OF A MINERAL ON AN ENDLESS CHAIN

[75] Inventor: Michel Benoit, Puteaux, France

[73] Assignee: Delattre-Levivier, Courbevoie, France

[21] Appl. No.: 644,173

[22] Filed: Dec. 24, 1975

[30] Foreign Application Priority Data

Jan. 15, 1975 [FR] France ..... 75 01061

[51] Int. Cl.[2] ..... F27B 9/12; C22C 1/20

[52] U.S. Cl. ..... 432/36; 75/5; 75/200; 264/40.1; 264/109; 432/13

[58] Field of Search ..... 264/40.6, 117, 109, 264/125, 40.1; 432/17, 24, 48, 78, 19, 36, 77, 80, 121, 136, 137, 144, 159, 54, 45, 13; 425/143, 145; 266/80, 87, 88, 91, 15 BC, 15 BF, 128; 75/3, 5, 200

[56] References Cited

U.S. PATENT DOCUMENTS

| | | | |
|---|---|---|---|
| 1,474,859 | 11/1923 | Swart | 266/178 |
| 2,676,095 | 4/1954 | De Vaney et al. | 432/17 |
| 2,785,063 | 3/1957 | Haley et al. | 432/17 |
| 2,948,918 | 8/1960 | Austin | 264/117 |
| 3,194,546 | 7/1965 | Schuerger et al. | 266/88 |
| 3,211,441 | 10/1965 | Miyakawa et al. | 266/88 |
| 3,262,770 | 7/1966 | Tsujihata et al. | 266/80 |
| 3,275,431 | 9/1966 | Sawada | 266/87 |
| 3,276,755 | 10/1966 | Bast | 432/48 |
| 3,381,946 | 5/1968 | Ross | 432/48 |
| 3,381,948 | 5/1968 | Stirling | 266/91 |
| 3,399,053 | 8/1968 | Schutz et al. | 266/87 |
| 3,578,298 | 5/1971 | Hurlbut et al. | 432/45 |
| 3,610,596 | 10/1971 | Snyder | 432/24 |
| 3,620,520 | 11/1971 | Ross | 432/48 |
| 3,746,537 | 7/1973 | Halbach | 266/80 |
| 3,760,048 | 9/1973 | Sullivan et al. | 23/313 |

FOREIGN PATENT DOCUMENTS

| | | | |
|---|---|---|---|
| 938,281 | 10/1963 | United Kingdom | 266/28 |

*Primary Examiner*—Willard E. Hoag
*Attorney, Agent, or Firm*—Haseltine, Lake & Waters

[57] ABSTRACT

A mineral agglomeration process in which a layer of mineral on an endless conveyor is passed through a firing zone provided with suction windboxes below the conveyor and connected to a common firing suction duct, and then through a cooling zone in which the product is cooled by air drawn through the layer by suction windboxes connected to a common cooling suction duct. The process is regulated by measuring the temperature of the gases in the common suction duct of the cooling zone and using a signal resulting from a comparison of the measured temperature and a preset temperature to control the flow of gases from the windboxes in the firing zone.

5 Claims, 1 Drawing Figure

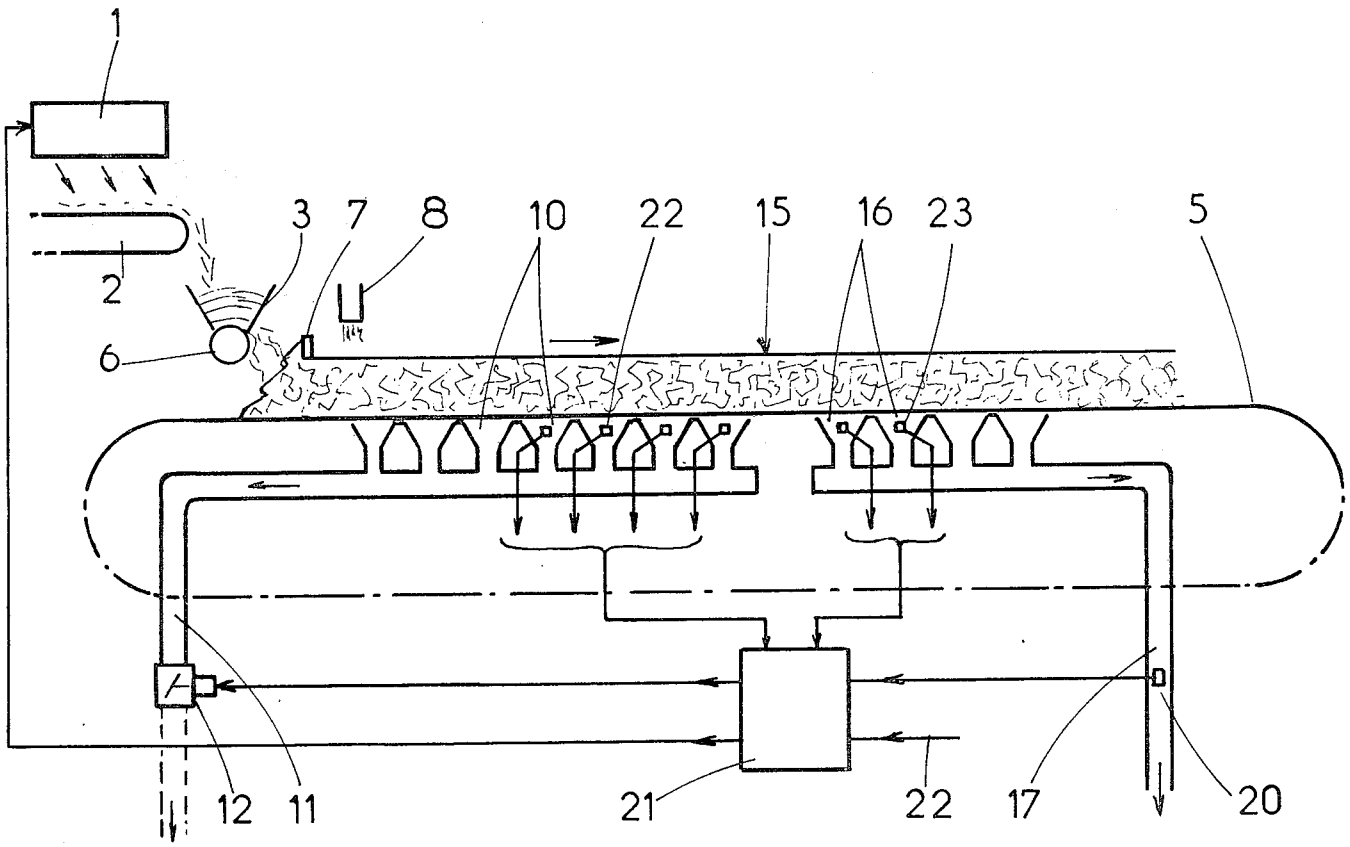
1
2
3
6
7
8
10
22
15
16
23
5
20
17
22
21
11
12

METHOD OF REGULATING THE PROCESS OF AGGLOMERATION OF A MINERAL ON AN ENDLESS CHAIN

FIELD OF THE INVENTION

The present invention relates to a method of regulating the process of agglomeration of a mineral.

BACKGROUND

In succession to conventional installations for agglomeration of minerals on a conveyor, in which the agglomerated mineral was discharged from the conveyor at the end of the firing, that is to say, at its maximum temperature, in order to be cooled in a separate installation, conveyors are now employed with integrated cooling. In these new installations the firing zone is followed by a cooling zone in which cold air passes through the agglomerated mass from top to bottom, the air being drawn through by suction windboxes arranged below the conveyor.

In a conventional agglomeration conveyor having separate cooling it is important to regulate the position of the firing point correctly. The firing point is to be understood as the point at which the flame front, starting from above the layer of material where ignition takes place, reaches the bottom portion of the layer, combustion then being complete throughout the whole thickness of the layer. If the duration of the firing is reduced by acceleration of the propagation of the flame front through the layer, the productive capacity of the conveyor is no longer employed at its maximum since one would have been able to obtain a greater flow of material by increasing the speed of the conveyor. Conversely, increase of the duration of the firing leads to the firing being imcomplete at the end of the conveyor, which increases the proportion of unfired, and hence rejected, fines and reduces the quality of the product provided. Hence, there is a definite economic interest in keeping the firing point at a specified point, while keeping the conveyor speed at its maximum.

In an agglomeration conveyor installation with integrated cooling, the object of the regulation is not, properly speaking, to keep the firing point at a predetermined point but to obtain agglomerated products leaving the conveyor at a given temperature and cooling air at a temperature which is not dangerous to the cooling fans and filters, that is to say, a temperature less than about 250° C. In short, too high a temperature of the products at the output from the conveyor brings about difficulties in handling them and the conveyor belts will be impaired by masses of the product which are still red hot. Conversely, if the temperature is too low the useable output of the installation will be reduced because part of the energy brought into play in the cooling zone will have been used to no avail.

But in fact one is also led to look, even in installations with integrated cooling, for regulation of the position of the firing point. That is, if the firing point shifts into the cooling zone the temperature of the cooling air becomes excessive and is incompatible with the characteristics of the cooling fan. In addition, because the fan is a volumetric system, an increase in temperature reduces the mass flow of air and hence its cooling capacity, which causes yet another supplementary increase in temperature. It only remains then to stop the process and cool the product on the stationary conveyor to the detriment of production.

If, on the contrary, the firing point shifts towards the ignition hood with shortening of the firing zone, part of the flow from the firing fan will be employed to do cooling. A new position of stability of the firing point will develop because the flow of gas will fall in the firing zone in the same way as the vertical speed of the flame front in the layer. But this will reduce the agglomeration and cooling performance since the transfer of heat from the material to the gases is proportional to the masses present. For the firing, the speed of flow of the air is then too low and the firing zone spreads, the flame front and the heat front separate too far and the quality of agglomeration and the fines are disturbed. Hence it is preferable, whatever the required production, to keep the firing point in its normal position, that is to say, so that the firing fan acts only in the firing zone and the cooling fan acts only to cool the agglomerated products.

Whether it is a question of finding an optimum temperature of the products discharged or a stable position of the firing point, one runs into great difficulty in checking these operating conditions satisfactorily.

A graph of the temperature of the agglomerate at the output from the conveyor is not continuous but may display a seccession of peaks corresponding with compact and impermeable incandescent fragments of agglomerate which have had difficulty in being cooled. Such measurement of the temperature of the agglomerate is therefore useful but difficult to use in automatic control.

It is equally difficult to determine the position of the firing point by measurement of the temperatures in the windboxes in the firing zone. Actually, the temperature measurements in the various windboxes give an apparently continuous curve which develops when the firing point shifts. But this curve is difficult to analyze by a computer and the actual shape of the flame front may be disturbed by differences in permeability of the layer between the middle and the edges of the installation. In addition, thermal inertia is very large in the firing zone, particularly due to the heat absorbed in evaporating the water contained in the mixture, with the result that even a large shift in the firing point is expressed only as a small variation in the measured temperatures.

According to the present invention, there is provided a method of regulating the process of agglomeration of a mineral on an endless conveyor, the mineral on the conveyor passing through a firing zone provided with suction windboxes under the grate connected to a common suction duct, and then a cooling zone in which the fired product is cooled by passing air through the layer of fired agglomerated products using suction windboxes connected to a common suction duct, the method comprising measuring the temperature of the gases in the common suction duct from the windboxes in the cooling zone, comparing the measured temperature with a preset temperature, and using a signal resulting from this comparison to act upon the flow of suction gases from the windboxes in the firing zone.

The invention will be more fully understood from the following description of an embodiment thereof, given by way of example only, with reference to the accompanying drawing of which the singe FIGURE is a diagrammatic view of an agglomeration installation with integrated cooling.

As shown in the drawing, materials, mineral, coke, water reject fines, reject fines to be agglomerated are stored at a proportioning station 1 wherefrom the required quantities are taken by a feeder 2 and discharged into a feed hopper 3. The rate of flow of the materials from the hopper onto a conveyor 5, the latter being disposed below the firing zone, is determined by the speed of a distributor roll 6 and the thickness of the layer is regulated by a gauge 7. The materials to be agglomerated are ignited by a device 8 and combustion spreads downwardly under the action of air drawn through windboxes 10, connected to a common firing suction flue 11 which in turn is connected to a common firing fan which is not shown in this simplified diagrammatic drawing. The suction flow is regulated by a control member 12 acting on a valve in the common flue. Beyond the zone 15 the flame front has reached the bottom portion of the layer and combustion is complete. The second portion of the conveyor 5 ensures cooling of the agglomerated product by suction of cold air through the layer by windboxes 16 connected to a common cooling suction flue 17 and to a cooling fan which is not shown in this simplified drawing. A temperature pick-up 20 in the cooling suction flue 17 measures the temperature of the air and transmits the information to a computer 21. It has been possible to observe that whatever the shape of the flame front in the layer of material on the conveyor 5, the average temperature of the cooling air measured at 20 in the main flue is an almost linear function of the position of the firing point on the grate. This measured temperature is compared in computer 21 with a reference value introduced at 22, which characterizes the normal position of the firing point on the grate.

A deviation signal produced by the computer 21 is then sent to the suction flow control 12 in order to adjust the opening of the firing valves to adjust the flow of gases through the windboxes 10. In this way the apparatus is operated at a constant conveyor speed, but with variations in the flow of gases in the firing zone. A rise in temperature in the common cooling suction flue 17, representing an advance of the firing point, will give rise to a reduction in the flow of gas through the firing zone, that is to say, a reduction in the speed of propagation of combustion in the layer and a consequential falling back of the firing point to bring it back to its normal position. The deviation signal produced by the computer may also be employed at the proportioning station to vary the proportioning of the materials and in particular the moisture content of the mixture.

It may be observed that the subordination thus established from measurement of temperature in the cooling flue and controlling the firing valves brings about an economy of electrical energy because it avoids even partially employing the firing fan for cooling, cooling being obtained solely by the cooling fan. The latter, being intended to make gases circulate through a more permeable layer is designed for a suction of about half that of the firing fan and is hence of distinctly lower power.

Of course, account can be taken of the temperature of the gases in the cooling flue only under conditions where such variations represent possible variations in the position of the firing point. Actually, a drop in temperature in the cooling flue may also proceed from a serious disturbance in the firing process, which might result, for example, in a stoppage of combustion. The regulation of the flow of firing gases by subordination to the temperature of the cooling gases is therefore completed by measurements of temperature in the windboxes 10 by means of pick-ups 22 so as to be able to check that the temperature in the normal zone of the firing point does not drop below a safety threshold. The measurements by the pick-ups 22, or a combination of these measurements, are introduced into the computer 21 so that, in the event of a serious disturbance, an alarm signal is generated and the normal operation of the control is interrupted. These check measurements may be completed by similar measurements in the cooling windboxes by means of pick-ups 23.

What is claimed is:

1. A method of regulating the process of agglomeration of products, the products including minerals, on an endless conveyor traveling at constant speed, comprising the steps of:

passing the products on the conveyor through a firing zone, the firing zone having a first set of suction boxes disposed below the conveyor, the first set of suction boxes being connected to a common firing suction duct;

passing the fired products on the conveyor through a cooling zone, the cooling zone having a second set of suction boxes disposed below the conveyor, the second set of suction boxes being connected to a common cooling suction duct, gases passing through the suction ducts;

measuring the temperature of the gases in the common cooling suction duct;

comparing the measured temperature with a preset temperature, a signal resulting from the temperature comparison; and regulating the flow of gases in the common firing suction duct from the comparison signal.

2. A method as claimed in claim 1, wherein the products include selected proportions of coke, water and waste products, the proportions being predetermined as a function of the comparison signal, and further comprising the step of controlling the product proportions as a function of the comparison signal.

3. A method as claimed in claim 1 wherein the materials have a predetermined moisture content as a function of the comparison signal, and further comprising the step of controlling the moisture content as a function of the comparison signal.

4. A method as claimed in claim 1, further comprising the step of measuring the temperature of the gases in at least some of the first set of suction boxes; and interrupting the regulation of the flow of gases when the gas temperatures in said some of the first set of suction boxes drops below a predetermined level.

5. A method as claimed in claim 4, further comprising the step of measuring the temperature of the gases in at least some of the second set of suction boxes; and interrupting the regulation of the flow of gases when the gas temperature in said some of the second set of suction boxes drops below a predetermined level.

* * * * *